US008891799B2

(12) United States Patent
Fujikura et al.

(10) Patent No.: US 8,891,799 B2
(45) Date of Patent: Nov. 18, 2014

(54) EARPHONE

(75) Inventors: Takashi Fujikura, Tokyo-to (JP); Kazunori Ishizaka, Tokyo-to (JP)

(73) Assignee: JVC Kenwood Corporation, Yokohama-shi (JP)

( * ) Notice: Subject to any disclaimer, the term of this patent is extended or adjusted under 35 U.S.C. 154(b) by 831 days.

(21) Appl. No.: 12/478,765

(22) Filed: Jun. 4, 2009

(65) Prior Publication Data

US 2009/0304220 A1 Dec. 10, 2009

(30) Foreign Application Priority Data

Jun. 4, 2008 (JP) ..... 2008-147450
Sep. 2, 2008 (JP) ..... 2008-224846
Nov. 27, 2008 (JP) ..... 2008-302845

(51) Int. Cl.
*H04R 25/00* (2006.01)
*H04R 1/10* (2006.01)

(52) U.S. Cl.
CPC ..... *H04R 1/1091* (2013.01)
USPC ..... 381/380; 381/309

(58) Field of Classification Search
CPC ... H04R 1/1016; H04R 25/652; H04R 25/656
USPC ..... 381/309, 380
See application file for complete search history.

(56) References Cited

U.S. PATENT DOCUMENTS 4,981,194 A * 1/1991 Kamon et al. ..... 181/129
5,015,225 A * 5/1991 Hough et al. ..... 600/25
7,778,434 B2 * 8/2010 Juneau et al. ..... 381/328
8,340,335 B1 * 12/2012 Shennib ..... 381/328
2002/0080990 A1 * 6/2002 Lin ..... 381/380
2004/0165742 A1 * 8/2004 Shennib et al. ..... 381/326
2006/0291683 A1 * 12/2006 Urso et al. ..... 381/328
2007/0049361 A1 * 3/2007 Coote et al. ..... 455/575.2
2007/0189570 A1 * 8/2007 Matsuo et al. ..... 381/382
2008/0013774 A1 * 1/2008 Hosaka et al. ..... 381/380
2008/0037801 A1 * 2/2008 Alves et al. ..... 381/71.6
2009/0052711 A1 * 2/2009 Murozaki ..... 381/328
2009/0141924 A1 * 6/2009 Her et al. ..... 381/380
2009/0202097 A1 * 8/2009 Tiscareno et al. ..... 381/380
2009/0226025 A1 * 9/2009 Howes et al. ..... 381/380
2010/0061580 A1 * 3/2010 Tiscareno et al. ..... 381/380

(Continued)

FOREIGN PATENT DOCUMENTS

JP 63-117196 U 7/1988
JP H08-237786 9/1996
JP 08-331679 12/1996
JP 9-252496 * 9/1997

(Continued)

*Primary Examiner* — A. Sefer
(74) *Attorney, Agent, or Firm* — Venable LLP; Michael A. Sartori; Tamatane J. Aga

(57) ABSTRACT

An earphone includes a cylindrical portion having an opening in one end and an audio output unit which outputs sound from one face. The audio output unit is fixed to the cylindrical portion such that another face is in contact with an end face of the one end of the cylindrical portion. The audio output unit and the cylindrical portion are insertable at least partially in the external auditory canal of a human being. The earphone further includes a thin-wall part provided in the cylindrical portion and a ring, made of a material of a greater specific gravity than the cylindrical portion, which is fixed to the inner surface. The ring is fixed in a position such that the ring overlaps in the axial direction of the cylindrical portion with respect to the thin-wall part.

11 Claims, 9 Drawing Sheets

(56) References Cited

U.S. PATENT DOCUMENTS

| | | | | |
|---|---|---|---|---|
| 2010/0111348 | A1* | 5/2010 | Tsao et al. | 381/380 |
| 2011/0058703 | A1* | 3/2011 | Saggio, Jr. | 381/380 |
| 2011/0110543 | A1* | 5/2011 | Ishizaka et al. | 381/309 |
| 2012/0163649 | A1* | 6/2012 | Haapapuro et al. | 381/380 |
| 2012/0269376 | A1* | 10/2012 | Matsuo et al. | 381/380 |

FOREIGN PATENT DOCUMENTS

| | | | |
|---|---|---|---|
| JP | H09-252496 | | 9/1997 |
| JP | 2000-165972 | | 6/2000 |
| JP | 2007-134815 | * | 5/2007 |
| KR | 2008089935 | * | 10/2008 |

* cited by examiner

EARPHONE

CROSS-REFERENCE TO RELATED APPLICATIONS

The present application claims the priority benefit of Japanese patent application numbers 2008-147450 filed Jun. 4, 2008; 2008-224846 filed Sep. 2, 2008; and 2008-302845 filed Nov. 27, 2008. The disclosure of each of the aforementioned applications is incorporated herein by reference.

BACKGROUND OF THE INVENTION

1. Field of the Invention

The present invention relates to an earphone and, in particular, to an earphone that has an insertion part to be inserted in the external auditory canal of a user.

2. Description of the Related Art

Among various earphones on the market today, there are, for instance, canal type (earplug type) earphones with which the user hears sounds output from an audio output unit thereof, with the earpiece or the like inserted in the external auditory canal. And proposed for such canal type earphones are sound-insulating earphones, which includes an elongated earphone wrapped in a sound-insulating elastic member in order to prevent the leak of sound out of the ear. Also proposed are piezoelectric earphones having, for example, a piezoelectric acoustic member within an insertion tube to be inserted in the external auditory canal in order to make a sound generating portion located outside the external auditory canal smaller.

In recent years, the broadening use of portable music players has been accelerating the development of canal type earphones capable of outputting sounds of excellent quality. However, as is described in the above-cited references, locating the audio output unit inside the external auditory canal gives rise to the necessity to make the audio output unit smaller. Generally, the smaller the audio output unit is, the more difficult it will be to output sounds of better quality. Hence, in locating the audio output unit inside the external auditory canal, the problem to be addressed is to suppress the quality loss of sounds output therefrom.

SUMMARY OF THE INVENTION

Embodiments of the present invention solve the problems as described above by providing an earphone having an audio output unit to be held inside the external auditory canal with a reduced loss in sound quality.

Embodiments of the present invention include: (1) an earphone (110) comprising: a cylindrical portion (116*a*) having an opening in one end thereof; and an audio output unit (130) which outputs sound from one face thereof, the audio output unit (130) being fixed to the cylindrical portion (116*a*) such that another face (130*b*) thereof is in contact with an end face (116*a*1) of the one end of the cylindrical portion (116*a*), wherein at least part of the audio output unit (130) and at least part of the cylindrical portion (116*a*) is insertable in an external auditory canal; (2) an earphone (110) according to (1) further comprising a thin-wall part (116*h*) provided in the cylindrical portion (116*a*); and a ring (176), made of a material of a greater specific gravity than the cylindrical portion (116*a*), which is fixed to an inner surface of the cylindrical portion (116*a*), wherein the ring (176) is fixed in such a position that the ring overlaps in an axial direction of the cylindrical portion (116*a*) with respect to the thin-wall part (116*h*); (3) an earphone (110) according to (1) or (2), wherein the cylindrical portion (116*a*) is provided with a bottom face (116*p*) opposite to the another face (130*b*) of the audio output unit (130), and wherein a sound absorbing material (174) is placed in a space (BC) between the another face (130*b*) of the audio output unit (130) and the bottom face (116*p*); (4) an earphone (110) according to (1) or (2), further comprising: a unit holder (132) which houses the audio output unit (130) therein, wherein the thin-wall part (116*h*) is a ring-like groove provided on an external surface of the cylindrical portion (116*a*), and wherein a part of the unit holder (132) is inserted into the groove; (5) an earphone according to (2), wherein the cylindrical portion is formed of a resin and the material of a greater specific gravity than the cylindrical portion is a metal; and (6) an earphone (110) according to (4), wherein the unit holder (132) is formed of a metal.

BRIEF DESCRIPTION OF THE DRAWINGS

Embodiments of the present invention may be described with reference to the accompanying drawings which are meant to be exemplary, not limiting, and wherein like elements are numbered alike in several Figures in which.

DETAILED DESCRIPTION

Embodiments of the invention will now be described. This description is not intended to limit the scope of the present invention, but to exemplify embodiments of the invention.

First Embodiment

Figure 1C:
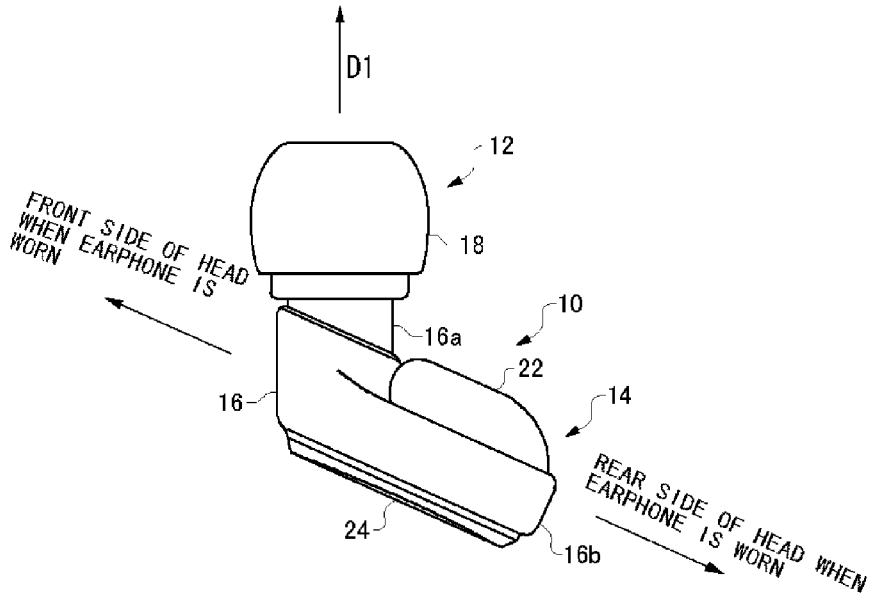
FIG. 1C is a top view of an earphone according to the first embodiment.
Figure 1B:
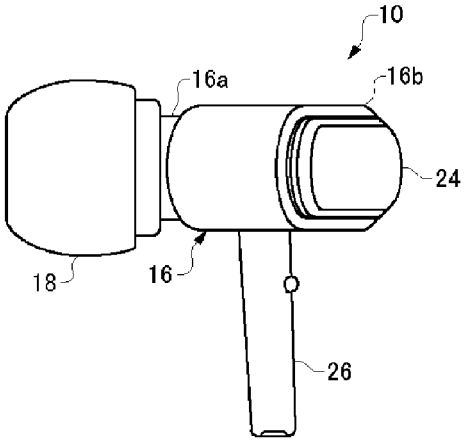
FIG. 1B is a left lateral view of an earphone according to the first embodiment.
Figure 1A:
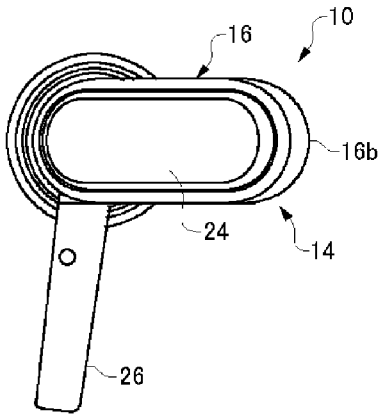
FIG. 1A is a front elevational view of an earphone according to a first embodiment of the present invention.

FIG. 1A is a front elevational view of an earphone 10 according to a first embodiment of the present invention. FIG. 1B is a left lateral view of the earphone 10 according to the first embodiment. FIG. 1C is a top view of the earphone 10 according to the first embodiment. FIGS. 1A to 1C represent an earphone 10 for the left ear.

The earphone 10 constitutes a part of an earphone unit (not shown) for stereo audio output. The earphone unit further includes an earphone for the right ear, a connection plug, and a cable. The earphone for the right ear (not shown) is formed plane-symmetrically to the earphone 10. The cable is disposed such that it forks halfway into two branches. The connection plug is coupled to the end of the trunk part of the cable, and the earphone 10 for the left ear and the earphone for the right ear are coupled to the ends of the respective branches thereof.

The connection plug is inserted to a headphone jack (not shown) of an audio output apparatus such as a portable music player. As electrical signals to be used for audio outputs enter the connection plug, those used for left-hand audio output are transmitted to the earphone 10 for the left ear, and those used for right-hand audio output to the earphone for the right ear, through the cable. Note, however, that the earphone unit may also be provided for monaural audio output. The earphone unit may not have two earphones but a single earphone for one ear only.

Figure 8:
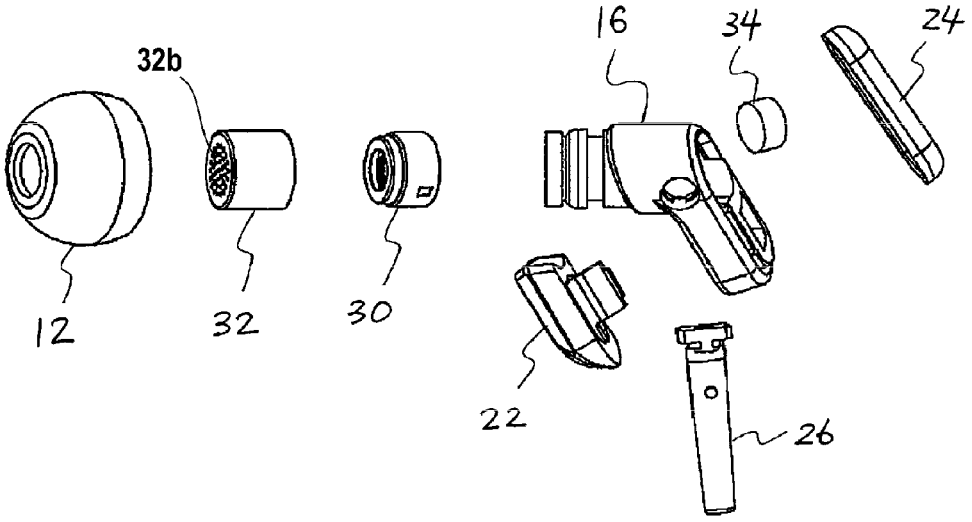
FIG. 8 is an exploded perspective view of an earphone according to a first embodiment.

A structure of the earphone 10 will be described with reference to FIGS. 1A to 1C. A description of the earphone 10 for the left ear is given, and thereby that of the earphone for the right ear is omitted. FIG. 8 is an exploded perspective view of the earphone 10, and the following explanation will be given by also referring to FIG. 8.

The earphone 10 includes a body 16, an earpiece 18, a cushion 22, an ornament 24, and a bushing 26. The body 16, which is formed of a resin, comprises a cylindrical portion 16*a* and a slanted portion 16*b* which projects radially outward from the cylindrical portion 16*a*. An axial direction of the cylindrical portion 16*a* is the insertion direction D1 of the earphone 10 in which it is inserted into the external auditory canal. The earpiece 18 is attached to an end of the cylindrical portion 16*a*. The cushion 22 is attached to a side surface of the slanted portion 16*b* on the side where the cylindrical portion 16*a* extends. The ornament 24 is attached to a front surface of the body 16, and the bushing 26 is attached to a lower surface of the body 16 such that the bushing 26 extends downward.

The constituent components of the earphone 10, including the cylindrical portion 16*a* and the earpiece 18, which extend in the insertion direction D1 into the external auditory canal will be referred to as an insertion part 12. The constituent components of the earphone 10, including the slanted portion 16*b* and the cushion 22, which project radially outward from the insertion part 12 will be referred to as an insertion restricting part 14. In use, an end of the insertion part 12 is inserted into the external auditory canal of a user. The insertion restricting part 14 restricts insertion of the insertion part 12 beyond a supposed insertion depth by coming into contact with part of the auricle of ear.

Figure 2B:
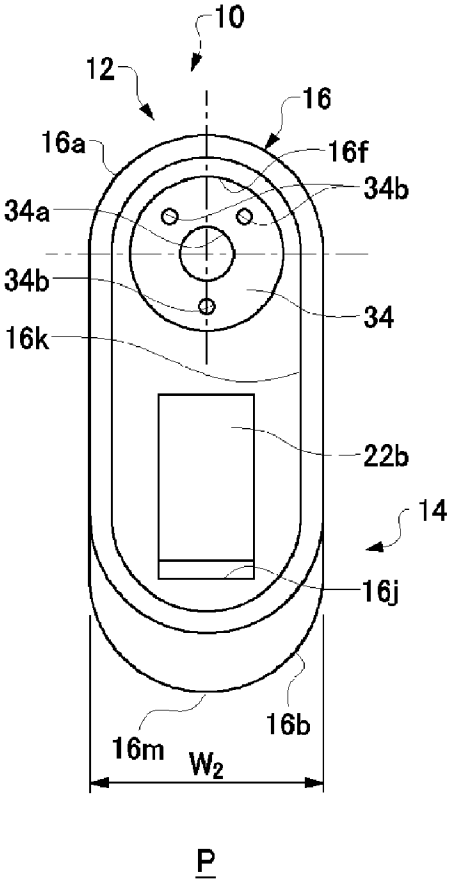
FIG. 2B is a view of an earphone without an ornament as viewed from a viewpoint P in FIG. 2A.
Figure 2A:
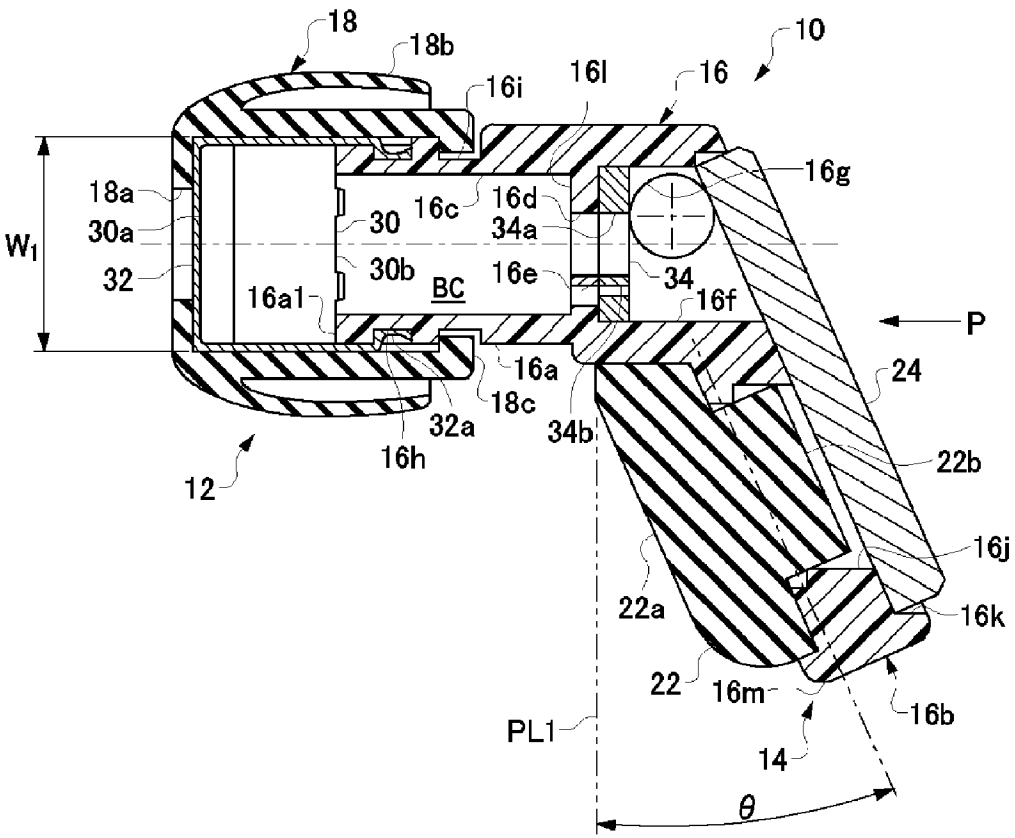
FIG. 2A is a cross-sectional view of an earphone according to a first embodiment as viewed from below.

FIG. 2A is a cross-sectional view of the earphone 10 according to the first embodiment as viewed from below, and FIG. 2B is a view of the earphone 10 without the ornament 24 as viewed from a viewpoint P in FIG. 2A. With reference to FIGS. 2A and 2B, a structure of the earphone 10 will be explained in detail below.

The earphone 10 further includes a driver unit 30, a unit holder 32, and a damping gel 34. The driver unit 30 is formed in a short cylinder having the same outside diameter as the cylindrical portion 16*a*. The driver unit 30 outputs vibration sound of a diaphragm (not shown) driven as electrical signals are supplied to a voice coil (not shown), into the external auditory canal. Thus the driver unit 30 functions as an audio output unit. One of the end faces of the driver unit 30 is an audio output face 30*a* where sounds emitted from the diaphragm are output. Also, provided on a rear face 30*b* side is a pair of terminals 30*t* to which lead wire for transmitting electrical signals supplied from outside is connected.

The unit holder 32 is formed such that the inside diameter thereof is the same as the outside diameter of the driver unit 30. Also, a multiplicity of minute, round through holes 32*b* (see FIG. 8) are provided in the bottom of the unit holder 32 so that sound passes well. A locking projection 32*a*, which projects radially inward, is formed near an opening of the unit holder 32 by a caulking operation during assembly process. On the other hand, a first locking groove 16*h*, which is recessed radially inward, is formed in the vicinity of a leading end of the cylindrical portion 16*a* . The unit holder 32 holds the driver unit 30 therewithin with an audio output face 30*a* contacting with the bottom thereof and secures the driver unit 30 to the body 16 by having the locking projection 32*a* locked in the first locking groove 16*h* with an opening end 16*a*1 of the cylindrical portion 16*a* put on the rear face 30*b* of the driver unit 30. The above-mentioned locking is accomplished by forming the locking projection 32*a* with a caulking process.

The unit holder 32 is formed as a metal thin-walled cylinder having a bottom. Forming the unit holder 32 with metal can make the unit holder 32 thin and suppresses thickness of the insertion part 12. The unit holder 32 according to the first embodiment is formed of aluminum. It is evident to those skilled in the art, however, that the unit holder 32 may be formed not only of aluminum but also of any of other metallic materials such as copper alloys, iron-based materials and stainless materials. The arrangement may also be such that a surface treatment such as chrome plating is given to the unit holder 32.

It is to be noted here that, as will be described later, the whole of the driver unit 30 is held within the external auditory canal when the insertion part 12 is inserted in the external ear canal to the supposed insertion depth. To allow the driver unit 30 to be held within the external auditory canal, it is necessary that the driver unit 30 has a small enough diameter. The small enough diameter of the driver unit 30, on the other hand, renders it necessary that the built-in voice coil, permanent magnet and so forth be also small in size. As a result, the smaller the driver unit 30 gets, the more difficult it will be to suppress the quality loss of sounds output therefrom.

To solve this problem, the cylindrical portion 16*a* of the body 16 is provided with a back cavity region 16*c* having a cylindrical interior for forming a back cavity BC, which is a space with an opening in the end thereof. In this first embodiment, the back cavity region 16*c* is cylindrical in shape. The back cavity BC is demarcated by putting an opening end 16*a*1 of the cylindrical portion 16*a* on the rear face 30*b* of the driver unit 30. This back cavity BC can suppress the quality loss of sounds resulting from the use of a smaller driver unit 30. The back cavity BC as described above has a particularly advantageous effect of compensating for the loss in low-tone outputs which may otherwise result from the use of a smaller driver unit 30.

Further, the back cavity BC and the back cavity region 16*c* are so formed that a part thereof is held within the external auditory canal when the insertion part 12 is inserted in the external auditory canal to the supposed insertion depth. In this manner, the size of the portion of an earphone protruding outside the auricle due to the provision of the back cavity region 16*c* can be restricted.

The earpiece 18 is formed of an elastic material such as rubber. The earpiece 18 has a bottomed cylindrical portion, the bottom of which is provided with an audio output hole 18*a* which is a round through hole. The earpiece 18 is also provided with an umbrella portion 18*b* which is integrally coupled to the bottom of this cylindrical portion. A locking projection 18*c* projecting radially inward is formed near the opening of the cylindrical portion of the earpiece 18. On the other hand, a second locking groove 16*i* recessed radially inward is formed on the surface of the cylindrical portion 16*a* slightly further away from the opening thereof than the first locking groove 16*h*. With the locking projection 18*c* engaged with the second locking groove 16*i*, the earpiece 18 is mounted to the body 16 in such a manner that the cylindrical portion wraps around the whole of the unit holder 32. With a structure implemented as described above, the sound from the audio output face 30*a* of the driver unit 30 is output through the multiplicity of through holes 32*b* in the unit holder 32 and the audio output hole 18*a* of the earpiece 18.

The body 16 is provided with a gel insertion hole 16*f* which coaxially extends from the back cavity region 16*c* with a bottom portion 16*l* in between and opens to the front face of the body 16. The bottom portion 16*l* interposed between the back cavity region 16*c* and the gel insertion hole 16*f* is provided with a wire passage hole 16*d*, which is a through hole, and a plurality of venting holes 16*e*, which are also through holes. Lead wire connected to the driver unit 30 for supplying electrical signals is passed through the wire passage hole 16*d*. The venting holes 16*e* communicate the back cavity BC to the outside air such that the diaphragm built in the driver unit 30 vibrates smoothly.

Disposed in the gel insertion hole 16*f* is a disk-shaped damping gel 34 which has substantially the same outside diameter as the inside diameter of the gel insertion hole 16*f*. The damping gel 34 prevents noise produced, for example, by the cable rubbing against clothing from reaching the eardrum and reduces vibration sound which leaks outside by absorbing the vibration of the driver unit 30. Hence, the damping gel 34 is formed of a material with an excellent damping performance. The damping gel 34 is provided with a wire passage hole 34*a* and venting holes 34*b* formed in the same shapes and positions as those of the wire passage hole 16*d* and venting holes 16*e*. The damping gel 34 is inserted into the gel insertion hole 16*f* until it contacts the bottom portion. Also provided in a side wall of the gel insertion hole 16*f* is a bushing insertion hole 16*g* for mounting the bushing 26.

An ornament mounting portion 16*k* for mounting the ornament 24 is provided in the front face of the body 16. The ornament mounting portion 16*k* is shaped as a hollow to a uniform depth from the front face of the body 16. The ornament 24 is locked as it is inserted and fitted into the ornament mounting portion 16*k*. The ornament 24 is formed of an aluminum material, though it may of course be formed of a material other than that.

In the slanted portion 16*b* of the body 16, a cushion mounting hole 16*j* is provided that penetrates from the ornament mounting portion 16*k* to the back face thereof. The cushion 22 comprises an auricle contact portion 22*a* and a mounting projection 22*b*. The auricle contact portion 22*a* comes in contact with the auricle when the earphone 10 is worn in the ear of the user. The mounting projection 22*b* projects outward from the auricle contact portion 22*a* to mount the cushion 22 to the body 16. The cushion 22 is locked to the body 16 with the mounting projection 22*b* inserted and fitted into the cushion mounting hole 16*j*.

It is to be noted that, in the first embodiment, the insertion restricting part 14 extends at angle θ from a plane perpendicular to the insertion direction D1 (hereinafter referred to as "perpendicular plane PL1") as the insertion part 12 is inserted into the external auditory canal. Specifically, in consideration of the angle of the auricle with the direction extending the external auditory canal in the vicinity of the opening thereof, the insertion restricting part 14 extends in a direction of θ=23.5 degrees from the perpendicular plane PL1. Set at this angle, the earphone 10 can be so positioned that the ornament 24 extends in a front-rear direction, and both a pleasant feel and a refinement of design of the earphone 10 when worn can be realized. Note also that the insertion restricting part 14 may extend in a direction within an angle range of 20 degrees or more and 30 degrees or less from the perpendicular plane PL1. With the insertion restricting part 14 extending within such an angle range, both the pleasant feel and the refinement of design of the earphone 10 when worn is maintained.

Figure 3:
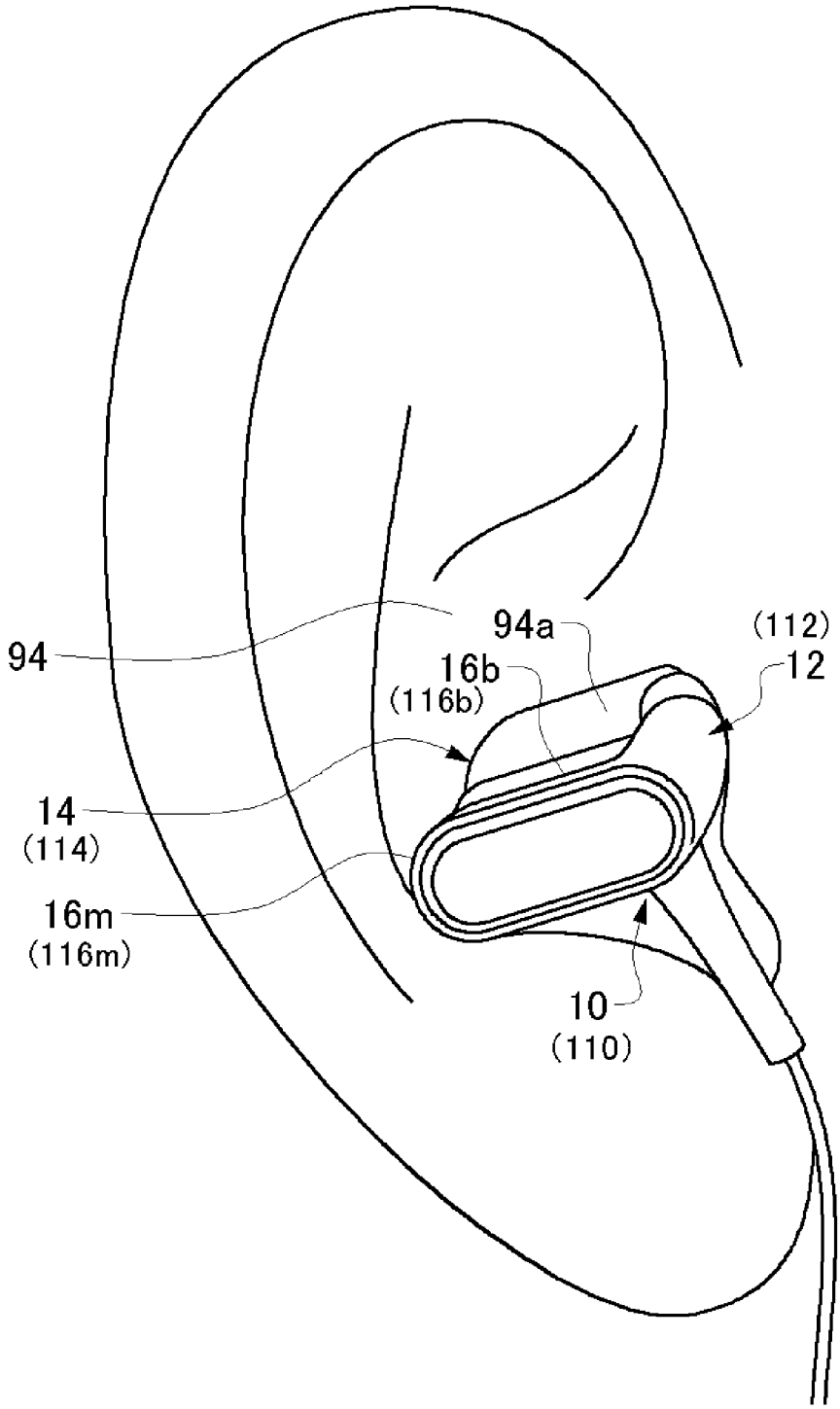
FIG. 3 is an external view showing a state of an earphone for the right ear worn in the right ear of a user.

FIG. 3 is an external view showing a state of an earphone 10 for the right ear worn in the right ear of a user. Note that the earphone 10 shown in FIG. 3 is formed in line symmetry with the earphone 10 for the left ear shown in FIGS. 1A to 1C and FIGS. 2A and 2B. An auricle 94 has a bowl-shaped region 94*a* around the opening of the external auditory canal. The slanted portion 16*b* is formed in such a length that an end portion 16*m* comes in contact with the inner wall of the bowl-shaped region 94*a* when the earphone 10 is worn in the ear of the user. As described earlier, the insertion restricting part 14 extends at angle θ from the perpendicular plane PL1. Accordingly, with the slanted portion 16*b* being in contact with the inner wall of the bowl-shaped region 94*a*, there occurs a reaction force in the direction that the insertion part 12 is inserted in the external auditory canal. As a result, the user can have an excellent feel of the earphone 10 without its falling out easily.

Referring back to FIGS. 2A and 2B, the cushion 22 may extend to the position (tip end) of the end portion 16*m*. An elastic member, which is different from the cushion 22, may be provided in the position of the end portion 16*m*. In such an arrangement, the elastic member may be formed of a material softer than that of the cushion 22, allowing the wear feeling of the earphone 10 to be improved.

Further, the insertion restricting part 14 is formed such that the width in a direction perpendicular to both the direction of its own extension and the insertion direction D1 of the insertion part 12 inserted in the external auditory canal, namely, a second width $W_2$ in the left-right direction in FIG. 2B, is substantially the same as a first width $W_1$ in the same direction of the unit holder 32 of the insertion part 12. In the first embodiment, the driver unit 30 is housed in the insertion part 12. Hence, it is not necessary to house the driver unit 30 in the insertion restricting part 14, so that the width of the insertion restricting part 14 can easily be substantially the same as that of the insertion part 12.

The large width of the insertion restricting part 14 may lead to insufficient space for fingers to put on or off the insertion restricting part 14 when it is placed in the bowl-shaped region 94*a* of the ear. Therefore, the width of the insertion restricting part 14 being substantially the same as that of the insertion part 12 assures a space for fingers around the insertion restricting part 14, thus making it easier to put the earphone 10 in or out of the ear.

Second Embodiment

Figure 6:
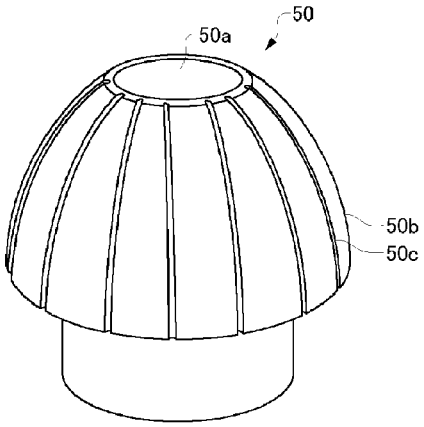
FIG. 6 is a perspective view showing an appearance of an earpiece according to a second embodiment of the present invention.

FIG. 6 is a perspective view showing an appearance of an earpiece 50 according to a second embodiment of the present invention. Note that the structure of an earphone according to the second embodiment is the same as that of the earphone 10 of the first embodiment except that the earpiece 50 is employed instead of the earpiece 18.

The rear face 30*b* of the driver unit 30 communicates with the outside air through the venting hole 16*e* and the venting hole 34*b*. However, since the driver unit 30 is covered with the external auditory canal, it is more difficult to ensure the communication between the audio output face 30*a* of the driver unit 30 and the outside air than when the driver unit 30 is located outside the ear canal.

To overcome this difficulty, an umbrella portion 50*b* of the earpiece 50 is provided with grooves 50*c* that run from the front end to the rear end thereof. This ensures a communication of the interior of the external auditory canal with the outside air through the grooves 50*c* when the user has inserted the earpiece 50 in the ear canal. This arrangement further allows a communication of the audio output face 30*a* with the outside air through the audio output hole 50*a* provided at the tip end of the earpiece 50, which in turn promotes a smooth vibration of the diaphragm 40.

Third Embodiment

Figure 7:
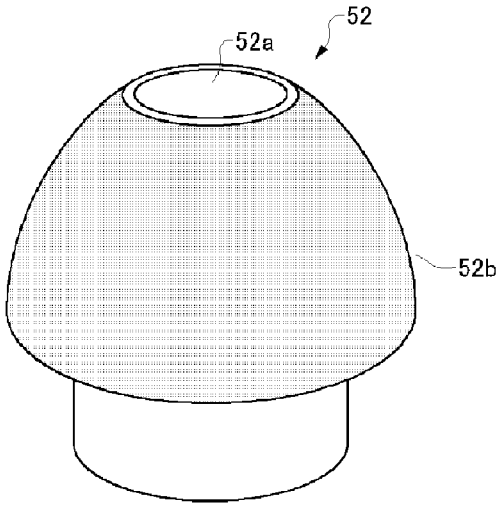
FIG. 7 is a perspective view showing an appearance of an earpiece according to a third embodiment of the present invention.

FIG. 7 is a perspective view showing an appearance of an earpiece 52 according to a third embodiment of the present invention. Note that the structure of an earphone according to the third embodiment is the same as that of the earphone 10 of the first embodiment except that the earpiece 52 is employed instead of the earpiece 18.

The whole external surface of an umbrella portion 52*b* of the earpiece 52 is provided with grains that are asperity in the thickness direction. This creates a large number of minute paths through which the air flows between the wall surface of the external auditory canal and the external surface of the umbrella portion 52*b* when the user has inserted the earpiece 52 in the ear canal. As a result, the interior of the external auditory canal can be communicated with the outside air through the external surface of the umbrella portion 52*b*. Consequently, the audio output face 30*a* is communicated with the outside air through the audio output hole 52*a* provided at the tip end of the earpiece 52, which further promotes a smooth vibration of the diaphragm 40.

Fourth Embodiment

As compared with the first embodiment, a fourth embodiment further comprises a sound absorbing sheet 170, a dust-proof sheet 172, a sound absorbing piece 174, a ring 176, and a weight 178. A description is given hereunder of an earphone 110 using FIG. 9A to FIG. 11.

Figure 9C:
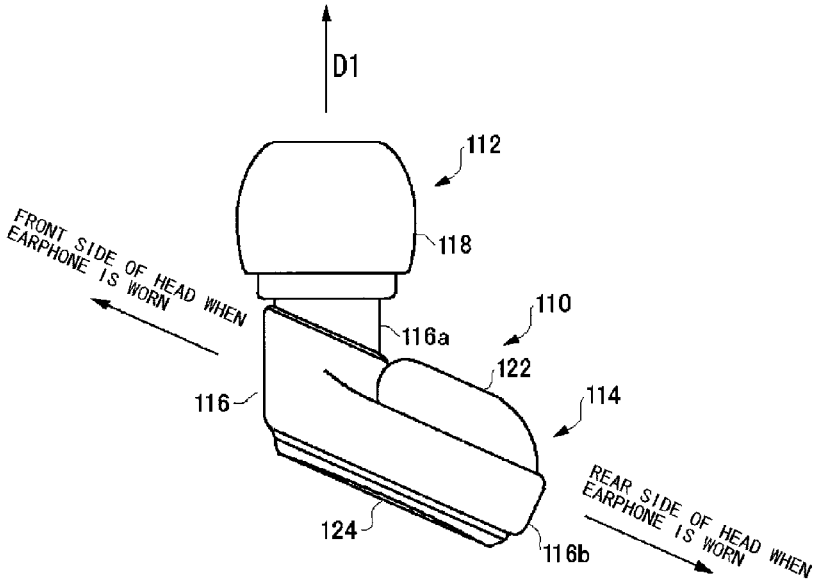
FIG. 9C is a top view of an earphone according to the fourth embodiment.
Figure 9B:
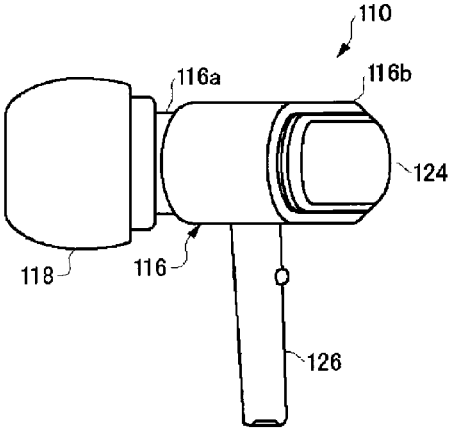
FIG. 9B is a left lateral view of an earphone according to the fourth embodiment.
Figure 9A:
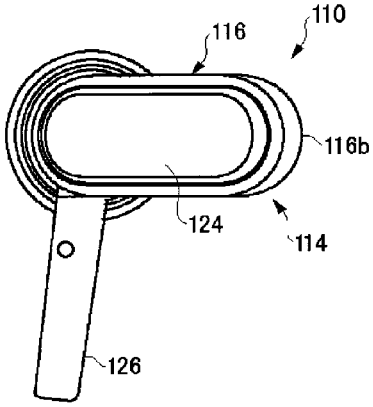
FIG. 9A is a front elevational view of an earphone according to a fourth embodiment of the present invention.

FIG. 9A is a front elevational view of an earphone 110 according to the fourth embodiment of the present invention. FIG. 9B is a left lateral view of the earphone 110 according to the fourth embodiment. FIG. 9C is a top view of the earphone 110 according to the fourth embodiment. FIGS. 9A to 9C represent an earphone 110 for the left ear.

The earphone 110 constitutes a part of an earphone unit (not shown) for stereo audio output. The earphone unit further includes an earphone for the right ear, a connection plug, and a cable. The earphone for the right ear (not shown) is formed plane-symmetrically to the earphone 110. The cable is disposed such that it forks halfway into two branches. The connection plug is coupled to the end of the trunk part of the cable, and the earphone 110 for the left ear and the earphone for the right ear are coupled to the ends of the respective branches thereof.

The connection plug is inserted to a headphone jack (not shown) of an audio output apparatus such as a portable music player. As electrical signals to be used for audio outputs enter the connection plug, those used for left-hand audio output are transmitted to the earphone 110 for the left ear, and those used for right-hand audio output to the earphone for the right ear, through the cable. Note, however, that the earphone unit may also be provided for monaural audio output. Also, the earphone unit may not have two earphones but a single earphone for one ear only.

A structure of the earphone 110 will be described with reference to FIGS. 9A to 9C. A description of the earphone 110 for the left ear is given, and thereby that of the earphone for the right ear is omitted.

The earphone 110 includes a body 116, an earpiece 118, a cushion 122, an ornament 124, and a bushing 126. The body 116, which is formed of a resin, comprises a cylindrical portion 116*a* and a slanted portion 116*b* which projects radially outward from the cylindrical portion 116*a*. An axial direction of the cylindrical portion 116*a* is the insertion direction D1 of the earphone 110 in which it is inserted into the external auditory canal. The earpiece 118 is attached to an end of the cylindrical portion 116*a*. Also, the cushion 122 is attached to a side surface of the slanted portion 116*b* on the side where the cylindrical portion 116*a* extends. The ornament 124 is attached to a front surface of the body 116, and the bushing 126 is attached to a lower surface of the body 116 such that the bushing 126 extends downward.

Hereinbelow, the constituent part of the earphone 110, including the cylindrical portion 116*a* and the earpiece 118, which extends in the insertion direction D1 into the external auditory canal will be referred to as an insertion part 112. Also, the constituent part of the earphone 110, including the slanted portion 116*b* and the cushion 122, which projects radially outward from the insertion part 112 will be referred to as an insertion restricting part 114. In use, an end of the insertion part 112 is inserted into the external auditory canal of a user. The insertion restricting part 114 restricts insertion of the insertion part 112 by coming into contact with part of the auricle of the ear when the insertion part 112 is inserted to a supposed insertion depth.

Figure 10B:
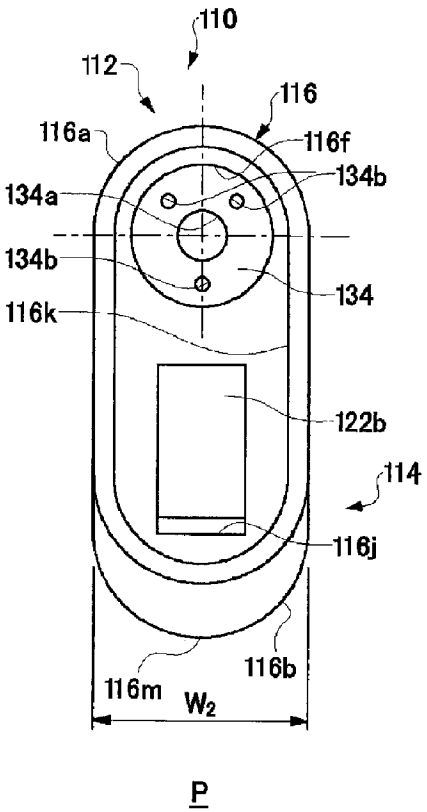
FIG. 10B is a view of an earphone without an ornament as viewed from a viewpoint P in FIG. 10A.
Figure 10A:
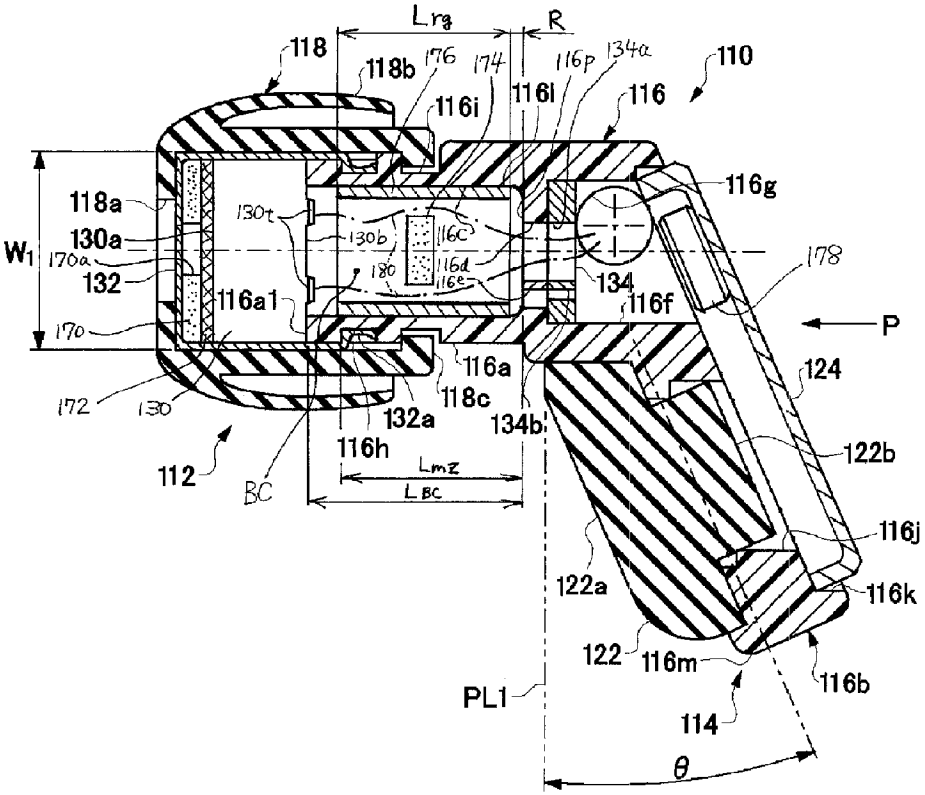
FIG. 10A is a cross-sectional view of an earphone according to a fourth embodiment as viewed from below.
Figure 11:
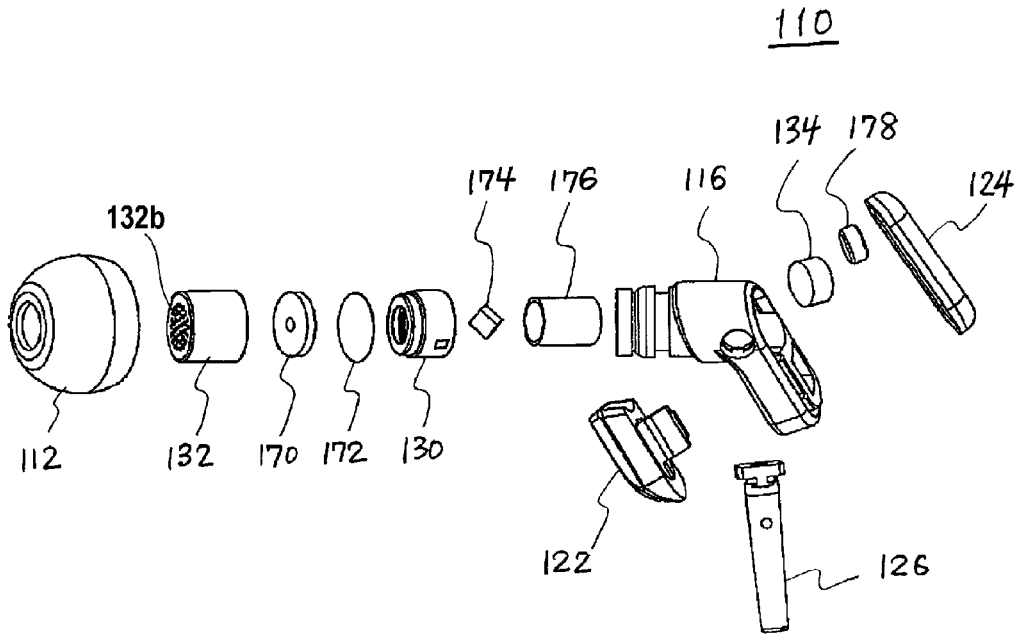
FIG. 11 is an exploded perspective view of an earphone according to a fourth embodiment.

FIG. 10A is a cross-sectional of the earphone 110 according to the fourth embodiment as viewed from below, and FIG. 10B is a view of the earphone 110 without the ornament 124 as viewed from a viewpoint P in FIG. 10A. FIG. 11 is an exploded perspective view of an earphone according to a fourth embodiment. With reference to FIGS. 10A and 10B, a structure of the earphone 110 will be explained in detail below.

The earphone 110 further includes a driver unit 130, a unit holder 132, and a damping gel 134. In addition, it further comprises a sound absorbing sheet 170, a dust-proof sheet 172, a sound absorbing piece 174, a ring 176, and a weight 178.

The driver unit 130 is formed in a short cylinder having the same outside diameter as the cylindrical portion 116*a*. The driver unit 130 outputs vibration sound of a diaphragm (not shown) driven as electrical signals are supplied to a voice coil (not shown), into the external auditory canal. Thus the driver unit 130 functions as an audio output unit. One of the end faces of the driver unit 130 is an audio output face 130*a* where sounds emitted from the diaphragm are output.

Also, provided on a rear face 130*b* side is a pair of terminals 130*t* to which lead wires 180 and 180 (indicated by dashed-dotted lines in FIG. 10A) for transmitting electrical signals supplied from outside is connected.

The sound absorbing sheet 170 is formed in a disk shape of predetermined thickness using a material of sound absorbing wool, for instance. In the center thereof, there is formed an opening 170*a* having about 21% of the outside diameter. Specific examples of its dimensions are as follows. The outside diameter thereof is 5.6 mm, the diameter of opening is 1.2 mm, and the thickness thereof is 0.5 mm, for instance. Note that the diameter of opening 170*a* is not limited to 21% thereof. The sound quality of high-tone range can be mainly adjusted by varying the opening area of this opening 170*a*. In particular, the smoothness in a high-tone range can be adjusted in terms of auditory effects. The sound absorbing sheet 170 suppresses undesirable effects of liquid substances, such as ear oil and sweat discharged in the external auditory canal, on the driver unit 130. Specifically, the sound absorbing wool absorbs the liquid substances that have entered inside through the minute and round through-holes of the unit holder 132 from the external auditory canal, thus preventing the liquid substances from reaching the driver unit 130. In terms of acoustic effects, a larger opening area of this opening 170*a* results in excellent reproduced sound. Also, the larger area thereof can more preferably prevent the phenomenon that the liquid substances absorbed by the sound absorbing sheet block the opening. On the other hand, a smaller opening area thereof is preferred in order to prevent earwax from reaching the driver unit 130. Accordingly, it is preferable that the opening area or the diameter of opening thereof be so set as to have a proper balance of both effects. The opening diameter of the opening 170*a* is preferably about 1.2 mm. In this manner, the absorbing sheet 170 is so provided that the acoustic quality of an earphone is adjusted optimally and is less likely to be affected by the liquid substances, such as ear oil, and earwax. It is desirable that the material of the sound absorbing sheet 170 absorbs the liquid substances, in addition to the property of absorbing sounds. Also, the thicker the predetermined thickness, more preferable in that the liquid substances can be stored. The material and dimensions of the sound absorbing sheet 170 can be set appropriately in view of the effects of tone control adjustment.

The dust-proof sheet 172 is formed of nonwoven cloth and prevents dust or fine foreign material from entering into the driver unit 130 from outside so as not to adversely affect the reproduced sound from the driver unit 130.

The unit holder 132 is formed such that the inside diameter thereof is the same as the outside diameter of the driver unit 130. Also, a multiplicity of minute, round through holes 132*b* (see FIG. 11) are provided in the bottom of the unit holder 132 so that sound passes well. On the other hand, a first locking groove 116*h*, which is recessed radially inward, is formed in the vicinity of the leading end of the cylindrical portion 116a. A locking projection 132*a*, which projects radially inward, is formed near the opening of the unit holder 132 by caulking operation during assembly process. More specifically, with the caulking operation, a part of the unit holder 132 is pushed out inwardly so as to be inserted into the first locking groove 16h and is finally fixed to the cylindrical portion 116*a*.

The mounting of the driver unit 130 using this unit holder 132 is carried out as follows. First, the sound absorbing sheet 170 and the dust-proof sheet 172 in this order are inserted to a bottom of the unit holder 132. Then the driver unit 130 is housed therewithin so that the audio output face 130*a* thereof is in contact with the dust-proof sheet 172. Then the rear face 130*b* of the driver unit 130 is put on an opening end 116*a*1 of the cylindrical portion 116*a*, and the unit holder 132 is urged on a cylindrical portion 116*a* side so that the sound absorbing sheet 170 is deformed a predetermined amount. In this state, the outer peripheral surface of the unit holder 132 disposed in a position corresponding to the first locking groove 116*h* is formed inwardly, through a caulking process, so as to form a locking projection 132*a*. The driver unit 130 is secured to the body 116 by having the locking the locking projection 132*a* inserted and then locked into the first locking groove 116*h*.

The predetermined amount of the sound absorbing sheet 170 in this mounting process may be, for example, about a half of the thickness of the sound absorbing sheet. This deformation amount may be an amount enough to secure the body 116 without causing looseness in the driver unit 130, and is not limited to any particular fixed amount.

The unit holder 132 is formed as a metal thin-walled cylinder having a bottom. Forming the unit holder 132 with metal can make the unit holder 132 thin and suppresses thickness of the insertion part 112. The unit holder 132 according to the fourth embodiment is formed of brass material. It is evident to those skilled in the art, however, that the unit holder 132 may be formed not only of copper-based material such as brass but also of any of other metallic materials such as aluminum-based materials or iron-based materials such as stainless. The arrangement may also be such that a surface treatment such as nickel plating or chrome plating is given to the unit holder 132.

Since the unit holder 132 is formed of such a metal as that described above, the sheet thickness thereof can be made extremely thin (0.15 mm, for instance). Thus, in such a case, a slight addition of 0.33 mm to the outside diameter of the cylindrical portion 116*a* enables the body 116 of the driver unit 130 to be secured, so that the increase in thickness of the insertion 112 can be suppressed.

It is to be noted here that, as will be described later, the whole of the driver unit 130 is held within the external auditory canal when the insertion part 12 is inserted in the external ear canal to the supposed insertion depth. To allow the driver unit 130 to be held within the external auditory canal, it is necessary that the driver unit 130 has a small enough diameter. The small enough diameter of the driver unit 130, on the other hand, renders it necessary that the built-in voice coil, permanent magnet and so forth be also small in size. As a result, the smaller the driver unit 130 gets, the more difficult it will be to suppress the quality loss of sounds output therefrom.

To solve this problem, the cylindrical portion 116*a* of the body 116 is provided with a back cavity region 116*c* having a cylindrical interior for forming a back cavity BC, which is a space with an opening in the end thereof.

In this fourth embodiment, the back cavity BC is provided as a space of a cylindrical shape. The back cavity BC is demarcated by putting an opening end 116*a*1 of the cylindrical portion 116*a* on the rear face 130*b* of the driver unit 130. This back cavity BC can suppress the quality of sounds resulting from the use of a smaller driver unit 130. The back cavity BC as described above has a particularly advantageous effect of compensating for the loss in low-tone outputs which may otherwise result from the use of a smaller driver unit 130.

Further, the back cavity BC and the back cavity region 116*c* are so formed that a part thereof is held within the external auditory canal when the insertion part 12 is inserted in the external auditory canal to the supposed insertion depth. In this manner, the size of the portion of an earphone protruding outside the auricle due to the provision of the back cavity region 116*c* can be restricted.

In this fourth embodiment, the sound absorbing piece 174 and the ring 176 are held inside the space of the back cavity region 116*c*.

A detailed description is first given of the ring 176. The ring 176 is a metallic pipe-shaped member. Brass is an example of metal used for this ring 176. The specific dimensions thereof are 0.25 mm in thickness, 4 mm in outside diameter ϕ and 5.5 mm in length, for example. This ring 176 is used to improve the quality of reproduced sound. It is preferable that a material with a specific gravity larger than that of at least the material used for the body 116 be used. The larger the specific gravity, the more significant effect on improvement in the sound quality can be expected. Thus brass is preferred in terms of specific gravity and manufacturability.

The ring 176 is so formed that the outside diameter thereof is almost the same as the inside diameter of the back cavity region 116*c*. As a result, the ring 176 is held within the back cavity region 116*c* without causing looseness inside the back cavity region 116*c*. The outer peripheral surface of the ring 176 is fixed to the inner peripheral surface of the back cavity region 116*c* using an adhesive.

In this fourth embodiment, the back cavity region 116*c* is subjected to so-called "rounding" in a back corner region thereof. Thus, the tip end of the ring 176 is positioned in the back corner region of the back cavity region 116*c*. This positioning of the tip end of the ring 176 determines an axial location of the ring 176 in the back cavity region.

More specifically, if the length of the ring 176 is defined and denoted as "Lrg" as depicted in FIG. 10A, the tip end of the ring 176 is located in a position toward the opening side by R nearer from a bottom face 116*p* of the back cavity region 116*c*, whereas the other end (rear end) is located in a position of R+Lrg from the bottom face 116*p*.

It is desirable that a thin-wall part of the cylindrical portion 116*a* is contained in a range where the ring 176 occupies, in the axial direction of the cylindrical portion 116*a*. In other words, as shown in FIG. 10A, the thin-wall parts of the cylindrical portion 116*a* in this fourth embodiment are a first locking groove 116*h* and a second locking groove 116*i*; where Lmz is the distance from the bottom face 116*p* to an opening-side end of the first locking groove 116*h* located on a far side than the second locking groove 116*i*, the dimensions of the respective components are set in a manner such that Lmz>Lrg+R.

In the fourth embodiment, the average wall thickness of the cylindrical portion 116*a* is 1.05 mm and the depth of the first and the second locking groove is 0.6 mm, so that the remaining wall thickness is 0.45 mm. In other words, the cylindrical portion 116*a* is such that the wall thickness of each groove is about 43% of the average wall thickness of the cylindrical portion 116*a*.

In this fourth embodiment, the driver unit 130, which is a vibrating source and weighs relatively heavy, is arranged at an end of the cylindrical portion 116*a*. Thus it is preferable that the rigidity of the cylindrical portion 116 be as high as possible. Suppose that the rigidity of the cylindrical portion 116*a* is not enough. Then the output of sounds in the driver unit 130 will result in quite a bit of deformation of the cylindrical portion 116*a*. As a result of drastic change in wall thickness of the cylindrical portion 116*a*, the vibration directly propagating from the driver unit 130 is not conveyed smoothly to the body 116, which in turn making it difficult to improve the reproduced sound because of possible adverse effects on the reproduced sound.

In consideration of the possible adverse effects, the ring 176 according to the present embodiments is arranged integrally with the cylindrical portion 116*a*, so that the rigidity of the cylindrical portion 116*a* increases and therefore the cylindrical portion 116*a* is extremely hard to deform when the driver unit 130 output sounds. Also, the ring 176 is arranged so that it contains the first locking groove 116*h* and the second locking groove 116*i*, constituting its thin wall parts, in the axial direction of the cylindrical portion 116*a*. As a result, not only the rigidity of the cylindrical 116*a* increases but also the vibration propagates smoothly through the cylindrical portion 116*a*. Hence, the reproduced sound can be further improved without any possible adverse effects thereon. In terms of auditory effects, the provision and proper arrangement of the ring 176 achieves an advantageous effect of obtaining clearer sound image.

Next, a description is given of the sound absorbing piece 174. The sound absorbing piece 174 is formed in a rectangular parallelepiped shape using a sound absorbing wool material. Specific examples of its dimensions include length×width×height=2×2×1 mm. The shape of the sound absorbing piece 174 is not limited to the rectangular parallelepiped, and the sound absorbing piece 174 may be of any shape as long as it can be contained in at least the back cavity BC.

The sound absorbing piece 174 is not tightly fixed in the back cavity BC but is held, in a natural state, within a space (back cavity BC) in contact with and surrounded by the bottom face 116*p* of the back cavity region 116*c*, the inner peripheral surface of the ring 176 (or inner peripheral surface of the back cavity region 116*c* if the ring 176 is not provided) and the rear surface 130*b* of the driver unit 130. In this space, two lead wires 180 and 180 are passed through toward the bottom face 116*p* from the terminal 130*t* at the rear face 130*b* of the speaker unit 130. The arrangement is such that these lead wires 180 and 180 are passed through a clearance between the sound absorbing piece 174 and the inner peripheral surface of the ring 176 (or inner peripheral surface of the back cavity region 116*c* if the ring 176 is not provided).

In the fourth embodiment, the effective volumetric capacity Vz of the back cavity BC is obtained approximately as follows. Specifically, Vz is obtained by subtracting the volumes of the ring 176 and two lead wires 180 and 180 from the inner space volume of the back cavity region 116*c*.

If the depth of the back cavity region 116c is denoted by Lbc, the cross-sectional area of the back cavity region 116*c* denoted Sbc, the volume of the ring 176 denoted Vrg and the radius of the lead wire 180 denoted $\phi_r$, then $Vz=Sbc \times Lbc - Vrg - \pi r^2 \times Lbc \times 2$.

If the specific values where Lbc=7.2 mm, $Sbc=(2.05)^2 \times \pi = 13.2\ mm^2$, $Vrg=16.7\ mm^3$, and r=0.03 mm, for example, are substituted into the above equation, Vz=95−16.7−0.02×2 (i.e., two lead wires)=78.26 $mm^3$.

At the same time, since the volume Vk of the sound absorbing piece 174 is $Vk=2\times2\times1=4\ mm^3$, the ratio Vk/Vz of the volume Vk of the sound absorbing piece 174 to the effective volumetric capacity of the back cavity BC is 4/78.26=0.051.

The provision and placement of the sound absorbing piece 174 within the back cavity BC allows the adjustment of sound quality of reproduced sound. Specifically, it makes the reproduced sound more crisp and clear and improves the articulation thereof in terms of auditory effects, especially in the low-tone range and mid-tone range. If the sound absorbing piece 174 is arranged in an excessive manner, the sound volume feeling of low-tone range may be reduced or lost. It appears this is because the effective volumetric capacity Vz of the back cavity BC responsible for the increase in low-tone output is practically reduced. The volume of the sound absorbing piece 174 to be arranged is not limited to a volume determined by the volume ratio Vk/Vz=0.051 of the fourth embodiment, and this ratio is preferably in a range of 0.02 to 0.20.

The earpiece 118 is formed of an elastic material such as rubber. The earpiece 118 has a bottomed cylindrical portion, the bottom of which is provided with an audio output hole 118*a* which is a round through hole. The earpiece 118 is also provided with an umbrella portion 118*b* which is integrally coupled to the bottom of this cylindrical portion. A locking projection 118*c* projecting radially inward is provided near the opening of the cylindrical portion of the earpiece 118. On the other hand, a second locking groove 116*i* recessed radially inward is provided on the surface of the cylindrical portion 116*a* slightly further away from the opening thereof than the first locking groove 116*h*. With the locking projection 118*c* engaged with the second locking groove 116*i*, the earpiece 118 is mounted to the body 116 in such a manner that the cylindrical portion wraps around the whole of the unit holder 132. With a structure implemented as described above, the sound from the audio output face 130*a* of the driver unit 130 is output through the multiplicity of through holes 132*b* (see FIG. 11) in the unit holder 132 and the audio output hole 118*a* of the earpiece 118.

The body 116 is provided with a gel insertion hole 116*f* which coaxially extends from the back cavity region 116*c* with a bottom portion 116*l* in between and opens to the front face of the body 116. The bottom portion 116*l* interposed between the back cavity region 116*c* and the gel insertion hole 116*f* is provided with a wire passage hole 116*d*, which is a through hole, and a plurality of venting holes 116*e*, which are also through holes. Wires (lead wires 180 and 180) connected to the driver unit 130 for supplying electrical signals are passed through the wire passage hole 116*d*. The venting holes 116*e* communicate the back cavity BC to the outside air such that the diaphragm 140 built in the driver unit 130 vibrates smoothly.

Disposed in the gel insertion hole 116*f* is a disk-shaped damping gel 134 which has substantially the same outside diameter as the inside diameter of the gel insertion hole 116*f*. The damping gel 134 prevents noise produced, for example, by the cable rubbing against clothing from reaching the eardrum and reduces vibration sound which leaks outside by absorbing the vibration of the driver unit 130. Hence, the damping gel 134 is formed of a material with an excellent damping performance. The damping gel 134 is provided with a wire passage hole 134*a* and venting holes 134*b* formed in the same shapes and positions as those of the wire passage hole 116*d* and venting holes 116*e*. The damping gel 134 is inserted into the gel insertion hole 116*f* until it contacts the bottom portion. Also provided in a side wall of the gel insertion hole 116*f* is a bushing insertion hole 116*g* for mounting the bushing 26.

An ornament mounting portion 116*k* for mounting the ornament 214 is provided in the front face of the body 116. The ornament mounting portion 116*k* is shaped as a hollow to a supposed depth from the front face of the body 116. The ornament 124 is locked as it is inserted and fitted into the ornament mounting portion 116*k*. The ornament 124 is formed by press-working a plate material made of stainless-steel (SUS 304). It goes without saying that the ornament 124 may be formed of other material such as aluminum or brass.

A weight 178 is fixed to a rear face 124 (internal surface) of the ornament 124, using an adhesive or the like. The weight 178 is formed of a stainless material (e.g., SU 304), for instance. The weight 178 serves as a weight that weighs relatively heavy and achieves an advantageous effect of improving reproduced sound leading to clearer sound by absorbing unwanted vibration generated in the driver unit 130

In the slanted portion 116*b* of the body 116, a cushion mounting hole 116*j* is provided that penetrates from the ornament mounting portion 116*k* to the back face thereof. The cushion 122 comprises an auricle contact portion 122*a* and a mounting projection 122*b*. The auricle contact portion 122*a* comes in contact with the auricle when the earphone 110 is worn in the ear of the user. The mounting projection 122*b* projects outward from the auricle contact portion 22*a* to mount the cushion 122 to the body 116. The cushion 122 is locked to the body 116 with the mounting projection 122*b* inserted and fitted into the cushion mounting hole 116*j*.

It is to be noted that also in the fourth embodiment, the insertion restricting part 114 extends at angle θ from a plane perpendicular to the insertion direction D1 (perpendicular plane PL1) as the insertion part 112 is inserted into the external auditory canal. Specifically, in consideration of the angle of the auricle with the direction extending the external auditory canal in the vicinity of the opening thereof, the insertion restricting part 114 extends in a direction of θ=23.5 degrees from the perpendicular plane PL1. Set at this angle, the earphone 110 can be so positioned that the ornament 124 extends in a front-rear direction, and both a pleasant feel and a refinement of design of the earphone 110 when worn can be realized. Note also that the insertion restricting part 114 may extend in a direction within an angle range of 20 degrees or more and 30 degrees or less from the perpendicular plane PL1. With the insertion restricting part 114 extending within such an angle range, both the pleasant feel and the refinement of design of the earphone 110 when worn is maintained.

The earphone according to the fourth embodiment is mounted to the ear similarly to the first embodiment. A description, though partially repeated, is now given referring to FIG. 3. FIG. 3 is an external view showing a state of an earphone 110 for the right ear worn in the right ear of a user. Note that the earphone 110 shown in FIG. 3 is formed in line symmetry with the earphone 110 for the left ear shown in FIGS. 9A to 9C and FIGS. 10A and 10B. An auricle 94 has a bowl-shaped region 94*a* around the opening of the external auditory canal. The slanted portion 116*b* is formed in such a length that an end portion 116*m* comes in contact with the inner wall of the bowl-shaped region 94*a* when the earphone 110 is worn in the ear of the user. As already described earlier, the insertion restricting part 114 extends at angle θfrom the perpendicular plane PL1. Accordingly, with the slanted portion 116*b* being in contact with the inner wall of the bowl-shaped region 94*a*, there occurs a reaction force in the direction that the insertion part 112 is inserted in the external auditory canal. As a result, the user can have an excellent feel of the earphone 110 without its falling out easily.

Referring back to FIGS. 10A and 10B, the cushion 122 may extend to the position (tip end) of the end portion 116*m*. An elastic member, which is different from the cushion 122, may be provided in the position of the end portion 116*m*. In such an arrangement, the elastic member may be formed of a material softer than that of the cushion 122, allowing the wear feeling of the earphone 110 to be improved.

Further, the insertion restricting part 114 is formed such that the width in a direction perpendicular to both the direction of its own extension and the insertion direction D1 of the insertion part 112 inserted in the external auditory canal, namely, a second width $W_2$ in the left-right direction in FIG. 10B, is substantially the same as a first width $W_1$ in the same direction of the unit holder 132 of the insertion part 112. In the fourth embodiment, the driver unit 130 is housed in the insertion part 112. Hence, it is not necessary to house the driver unit 130 in the insertion restricting part 114, so that the width of the insertion restricting part 114 can easily be substantially the same as that of the insertion part 112.

The large width of the insertion restricting part 114 may lead to insufficient space for fingers to put on or off the insertion restricting part 114 when it is placed in the bowl-shaped region 94*a* of the ear. Therefore, the width of the insertion restricting part 114 being substantially the same as that of the insertion part 112 assures a space for fingers around the insertion restricting part 114, thus making it easier to put the earphone 110 in or out of the ear.

Figure 4:
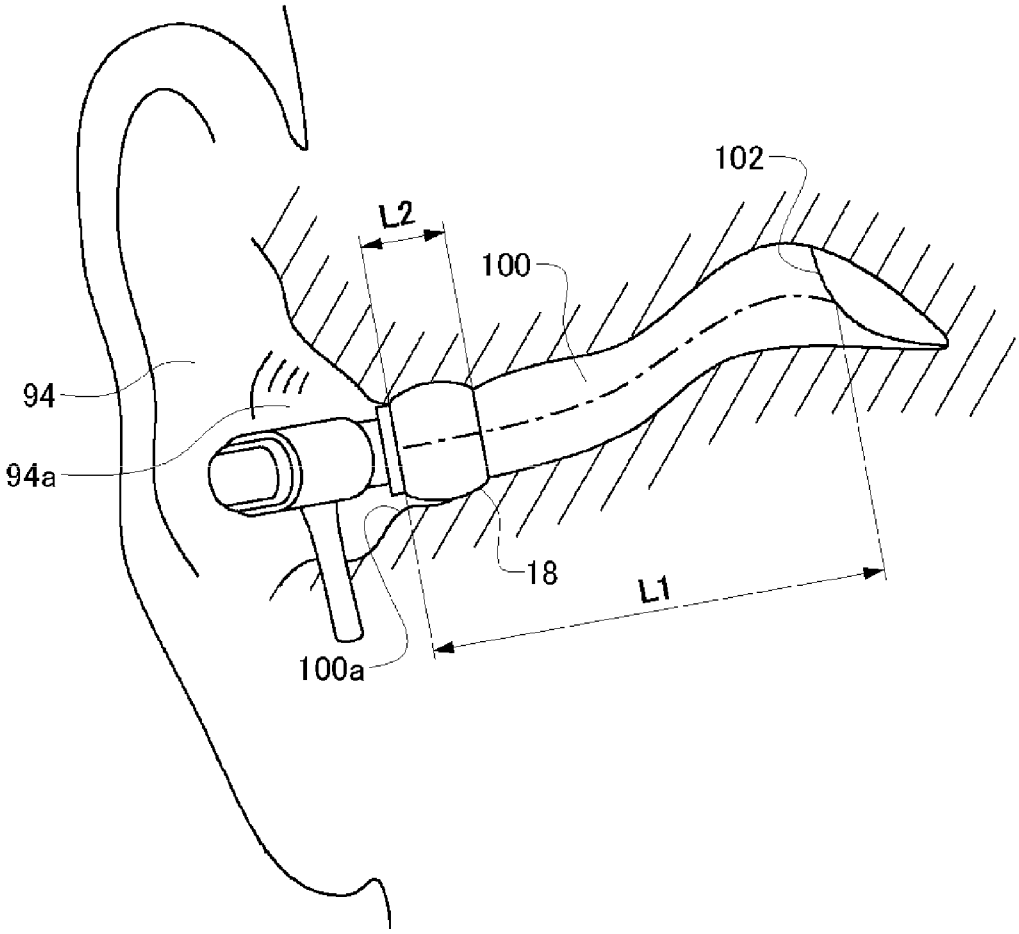
FIG. 4 illustrates a state where an earphone according to a first embodiment is mounted to the ear of a user.

FIG. 4 illustrates a state where an earphone 10 (110) according to the first and the fourth embodiment is mounted to the ear of a user. Here, for ease of explanation, a description is given of the earphone 10 according to the first embodiment but the same is applied to the earphone 110 according to the fourth embodiment. Also, for ease of understanding, FIG. 4 is a cross-sectional view of the periphery of the external auditory canal. In FIG. 4, the external auditory canal and the eardrum are shown as an external auditory canal 100 and an eardrum 102, respectively. In FIG. 4, L1 indicates the length of the external auditory canal, along a center line thereof, from an external auditory canal opening 100*a* to the eardrum 102. L2 indicates the depth of the earphone 10 from the external auditory opening 100*a* to the tip end of the earpiece 18 when the earphone 10 is inserted in the external auditory canal 100 to a supposed insertion depth. Note that the external auditory canal opening 100*a* corresponds to the boundary between the external auditory canal 100 and the bowl-shaped region 94*a*. Though the length L1 of external auditory canal varies depending on users, it is generally known to be in a range between 25 mm (inclusive) and 30 mm (inclusive). In the first embodiment, the supposed insertion depth L2 of the earphone 10 is 6 mm.

Figure 5A:
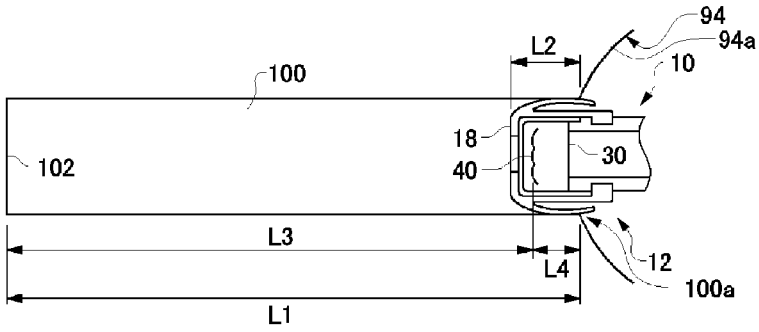
FIG. 5A is a schematic illustration showing a state where an earphone according to a first embodiment is mounted to the ear of a user.
Figure 5B:
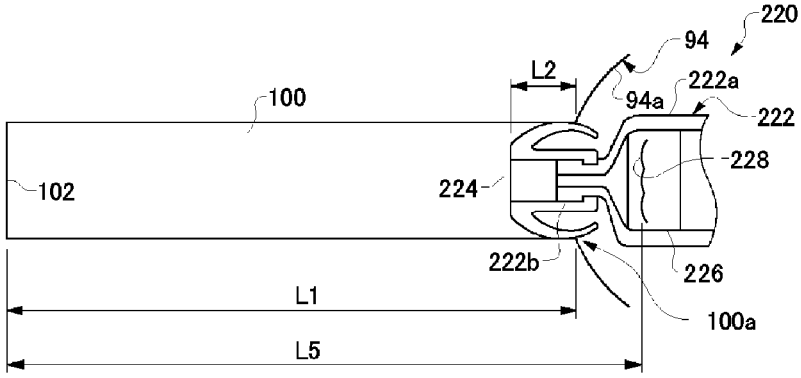
FIG. 5B is a schematic illustration showing a state where an earphone used for the comparison with the earphone according to a first embodiment is mounted to the ear of a user.

FIG. 5A is a schematic illustration showing a state where the earphone 10 according 10 to the first embodiment is mounted to the ear of a user. FIG. 5B is a schematic illustration showing a state where an earphone 220 used for the comparison with the earphone 10 according to the first embodiment is mounted to the ear of a user. A description is now given with reference to both FIG. 5A and FIG. 5B.

In general, the sound pressure applied to the eardrum by the earphone is inversely proportional to the square of the distance from the diaphragm, which is a sound source, to the eardrum. Accordingly, as the distance from the diaphragm to the eardrum gets shorter, the loss of sound pressure in the eardrum can be suppressed even when a driver unit whose maximum output is small is used. This is achieved by implementing the arrangement where the driver unit is located near the eardrum.

On the other hand, in order for the driver unit 30 to be held within the external auditory canal 100 when the insertion part 12 is inserted in a supposed insertion position, the driver unit 30 needs to be smaller in size. However, a smaller driver unit 30 may cause a loss in the maximum sound pressure that can be output. Under such circumstances, it may be necessary to appropriately locate the diaphragm 40 near the eardrum 102 to compensate for the loss in the maximum sound pressure resulting from the use of such a smaller driver unit 30. Specifically, a distance L3 between the diaphragm and the eardrum is defined to be a distance such that the sound reaches the eardrum at a sound pressure which is greater than or equal to an appropriate sound pressure suitably perceivable by a user.

In FIG. 5A, the diaphragm included in the driver unit 30 is shown as a diaphragm 40. L3 indicates a distance, along a center line of the external auditory canal 100, from the diaphragm 40 to the eardrum 102. In the earphone 10, the distance from the diaphragm 40 to the tip end of the earpiece 18 is 1.9 mm. As a result, the distance L3 from the diaphragm to the eardrum is in a range between 20.9 mm (inclusive) and 25.9 mm (inclusive). A distance L4 from the external auditory canal opening 100*a* to the diaphragm 40 is 4.1 mm.

The earphone 220 includes a body 222, an earpiece 224, and a driver unit 226. The body 222 has a unit container 222*a* and an earpiece mounting part 222*b* which are integrally coupled to each other. The unit container 222*a* is formed such that it is cylindrical in shape and the diameter thereof is larger than that of the external auditory canal 100. The earpiece mounting part 222*b* is formed such that it is cylindrical in shape and the diameter thereof is smaller than the external auditory canal 100. The driver unit 226, whose diameter is larger than that of the driver unit 30, is held within the unit container 222*a*. An earpiece 224 is attached to the earpiece mounting part 222*b*. When the earphone 220 is inserted to an ideal insertion position, the driver unit 226 is placed outside the external auditory canal 100. Similarly, a supposed insertion depth for the earphone 229 is 6 mm.

The driver unit 226 has a diaphragm 228 that vibrates and outputs sounds by the vibration. In FIG. 5B, L5 indicates a distance, along a center line of the external auditory canal 100, from the diaphragm 228 to the eardrum 102. In the earphone 220, the distance from the diaphragm 228 to the tip end of the earpiece 224 is 11.2 mm. As a result, the distance L5 from the diaphragm to the eardrum is in a range between 30.2 mm (inclusive) and 35.2 mm (inclusive).

Accordingly, compared for the same user, L3/L5 is 0.69 or more and 0.74 or less. Thus, if the driver unit 30 and the diaphragm 228 have the same maximum sound pressure, the sound pressure of sound that reaches the eardrum 102 in the earphone 10 will be larger than that of the earphone 220 by 2.6 dB or more and 3.2 dB or less. Conversely, if the sound pressure of sound that reaches the eardrum 102 is to be equal to that of the earphone 220, the maximum sound pressure that can be output from the earphone 10 may be smaller than that from the earphone 220 by 2.6 dB or more and 3.2 dB or less.

Even if the driver unit 30 is made smaller in size for the purpose of holding the driver unit 30 within the external auditory canal 100, the sound reaches the eardrum at a sound pressure which is greater than or equal to an appropriate sound pressure suitably perceivable by a user, in the same way as with the earphone 220. Even though the driver unit 30 is made smaller for the purpose of holding it within the external auditory canal 100, it is confirmed that the sound output from the diaphragm 40 reaches the eardrum at a sound pressure which is greater than or equal to an appropriate sound pressure suitably perceivable by a user if the distance L4 from the external auditory canal opening 100*a* to the diaphragm 40 is 3 mm or more.

In each of the above-described embodiments, an example of the resin that can be used for the body 16 (116) is a thermoplastic resin such as ABS (acrylonitrile butadiene styrene) resin. Glass fibers may be mixed in order to enhance the rigidity of the body 16 (116). In such a case, the mixing ratio of glass fibers may be about 20%.

In comparison with the first embodiment, the sound absorbing piece 174, the ring 176, and the weight 176 as explained in the fourth embodiment may each be provided as a single unit.

The present invention is not limited to the above-described embodiments only, and any combination of the above-described structural components as appropriate in each embodiment is effective as and encompassed by the present embodiments. Also, it is understood by those skilled in the art that various modifications such as changes in design may be made based on their knowledge and the embodiments added with such modifications are also within the scope of the present invention. Such modifications will be shown hereunder. An end of the cylindrical portion 16 (116) in contact with the rear face 30*a* (130*a*) of the driver unit 30 (130) is not limited to one the front surface of which is open. It suffices if part of it is open. Lead wire can be passed through this opening. Thus, the back cavity BC is disposed such that it comes in contact with at least the rear face 13*b* (130*b*) of the driver unit 30 (130), the inner surface (or the ring 176) of the cylindrical portion 16*a* (116*a*) and the back cavity region 16*c* (116*c*) disposed counter to the rear face 30*b* (130*b*).

While the embodiments of the present invention and their modifications have been described using specific terms, such description is for illustrative purposes only, and it is to be understood that changes and variations may still be further made without departing from the spirit or scope of the appended claims.

What is claimed is:

1. An earphone, comprising:

an insertion part at least part of which is inserted in an external auditory canal; and an audio output unit which outputs sound corresponding to electric signals supplied, the audio output unit being held within the external auditory canal when the at least part of the insertion part is inserted in the external auditory canal to an insertion position, the audio output unit including an audio output face from which the sound is output to the external auditory canal when the at least part of the insertion part is inserted in the external auditory canal, wherein the insertion position is a position of the insertion part when the end of the insertion part is inserted to a depth less than a length of the external auditory canal, wherein the insertion part has a space in contact with a rear face of the audio output unit, the space being isolated from a space in front of the audio output face, and the audio output face constituting a part of an external surface of the audio output unit, wherein the audio output unit comprises a diaphragm and a voice coil, wherein the audio output unit outputs sound into the external auditory canal as electrical signals supplied to the voice coil drive the diaphragm to vibrate, and wherein the audio output unit is mounted to the insertion part in such a manner that a distance from the external auditory canal opening to the diaphragm is 3 mm or more.

2. The earphone of claim 1, wherein the space in contact with the rear face of the audio output unit is provided in such a manner that at least part of the space in contact with the rear face of the audio output unit is held within the external auditory canal when the at least part of the insertion part is inserted in the external auditory canal to the insertion position.

3. The earphone of claim 1, further comprising a unit holder, mounted to the insertion part, which houses the audio output unit, wherein the unit holder is formed of a metal.

4. The earphone of claim 1, wherein the insertion part includes a cylinder formed cylindrically, wherein the space in contact with the rear face of the audio output unit is demarcated by an opening end of the cylinder abutted against the rear face of the audio output unit.

5. The earphone of claim 1, further comprising:

a unit holder provided such that a bottom thereof is located on the side of the external auditory canal when at least a part of the insertion part is inserted into the external auditory canal, wherein the unit holder holds the audio output unit such that the audio output face contacts the bottom.

6. The earphone of claim 1, wherein the whole of the audio output unit is held within the external auditory canal when at least a part of the insertion part is inserted in the external auditory canal to the insertion position.

7. The earphone of claim 1, wherein the insertion position is located at a distance of 6 mm from the external auditory canal opening.

8. An earphone, comprising:

an insertion part at least part of which is inserted in an external auditory canal;

an audio output unit which outputs sound corresponding to electric signals supplied, the audio output unit being held within the external auditory canal when the at least part of the insertion part which is inserted in the external auditory canal to an insertion position, the audio output unit including an audio output face from which the sound is output to the external auditory canal when the at least part of the insertion part is inserted in the external auditory canal; and an insertion restricting part which restricts insertion of the insertion part beyond the insertion position by coming into contact with a part of auricle of ear, wherein the insertion position is a position of the insertion part when the end of the insertion part is inserted to a depth less than a length of the external auditory canal, wherein the insertion part has a space in contact with a rear face of the audio output unit, the space being isolated from a space in front of the audio output face, and the audio output face constituting a part of an external surface of the audio output unit, wherein the insertion position is a position of the insertion part occurring when the insertion restricting part restricts the insertion of the insertion part, and wherein the insertion restricting part extends at an angle from a plane perpendicular to an insertion direction as the at least part of the insertion part which is inserted in the external auditory canal.

9. The earphone of claim 8, wherein a width of the insertion restricting part in a first direction is substantially the same as a width of the insertion part in the first direction, the first direction being perpendicular to both a direction of extension of the insertion restricting part and the insertion direction of the insertion part.

10. An earphone, comprising:

an insertion part at least part of which is inserted in an external auditory canal;

an earpiece which has a bottomed cylindrical portion, the bottom of which is provided with an audio output hole, the cylindrical portion being configured to wrap around a part of the insertion part; and an audio output unit which includes a driver unit and which outputs sound corresponding to electric signals supplied, the audio output unit being held within the external auditory canal when the at least part of the insertion part is inserted in the external auditory canal to an insertion position, the audio output unit including an audio output face from which the sound is output to the external auditory canal when the at least part of the insertion part is inserted in the external auditory canal, wherein the insertion position is a position of the insertion part when the end of the insertion part is inserted to a depth less than a length of the external auditory canal, wherein the insertion part has a space in contact with a rear face of the audio output unit, the space being isolated from a space in front of the audio output face, and the audio output face constituting a part of an external surface of the audio output unit, wherein the cylindrical portion of the earpiece is placed to wrap around the whole of the audio output unit and a portion of the space in contact with a rear face of the audio output unit, wherein the audio output face of the audio output unit is placed more toward the bottom of the cylindrical portion than the opening of the cylindrical portion.

11. The earphone of claim 10, wherein the driver unit comprises a diaphragm and a voice coil, wherein the audio output unit outputs sound into the external auditory canal as electrical signals supplied to the voice coil drive the diaphragm to vibrate, and wherein the audio output unit is mounted to the insertion part in such a manner that a distance from the external auditory canal opening to the diaphragm is 3 mm or more.

* * * * *